United States Patent [19]

Krajci et al.

[11] 4,071,720

[45] Jan. 31, 1978

[54] BINARY CODED CAM SELECTOR SWITCH HAVING SPLIT HOUSING AND DENT STRUCTURE

[75] Inventors: Gary Edward Krajci, Antioch; John Joseph Marrella, Broadview, both of Ill.

[73] Assignee: Motorola, Inc., Schaumburg, Ill.

[21] Appl. No.: 697,092

[22] Filed: June 17, 1976

[51] Int. Cl.[2] ..... H01H 19/00; G05G 5/06

[52] U.S. Cl. ..... 200/6 B; 200/6 BB; 200/291; 200/303; 74/527

[58] Field of Search ..... 74/527; 200/5 A, 6 R, 200/6 BA, 6 B, 6 BB, 17 R, 27 R, 30 R, 38 C, 153 L, 153 LB, 164 R, 241, 267, 268, 291, 302, 303

[56] References Cited

U.S. PATENT DOCUMENTS

| | | | |
|---|---|---|---|
| 2,225,344 | 12/1940 | Kimball | 200/6 BB |
| 3,200,208 | 8/1965 | Mastney | 200/6 R |
| 3,499,133 | 3/1970 | Tillack et al. | 200/291 X |
| 3,560,672 | 2/1971 | Ludlum et al. | 74/527 X |
| 3,562,467 | 2/1971 | Mooradian | 200/268 |
| 3,725,624 | 4/1973 | Emmons | 200/6 B X |
| 3,768,333 | 10/1973 | Bidwell | 74/527 X |
| 3,786,205 | 1/1974 | Lien | 200/267 X |
| 3,792,206 | 2/1974 | Purdy | 200/6 B |
| 3,999,021 | 12/1976 | Delp | 200/11 TW X |

FOREIGN PATENT DOCUMENTS

| | | | |
|---|---|---|---|
| 793,080 | 4/1958 | United Kingdom | 200/6 BB |

*Primary Examiner*—James R. Scott
*Attorney, Agent, or Firm*—Margaret Marsh Parker; James W. Gillman

[57] ABSTRACT

Unusually long life and reliability in a selector switch are achieved by providing long-wearing components which, in turn, contribute to an essentially dust-free environment for the contact portions of the switch. Materials of all parts produce a minimum of abrasion dust and the conformation of the housing structure prevents the entry of exterior dust. A binary coded cam having multiple cam sections causes sliding contact between spring type contact elements and shorting bars. The rotary element and the two main housing portions are molded of a highly wear resistant, low friction material. The detent mechanism is separated from the contact elements and the metal housing clamp locks the housing portions in the mated position, and helps to seal the housing against exterior dust. All components provide maximum life expectancy and low wear properties.

12 Claims, 6 Drawing Figures

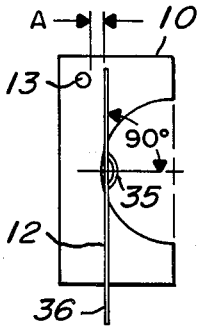
Fig. 3A
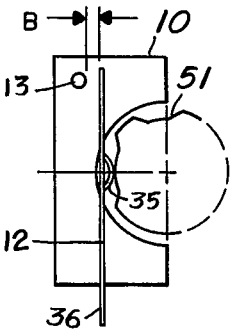
Fig. 3B
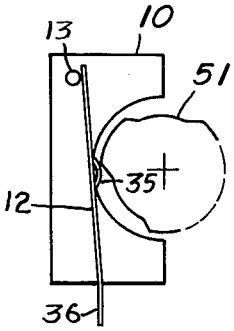
Fig. 3C
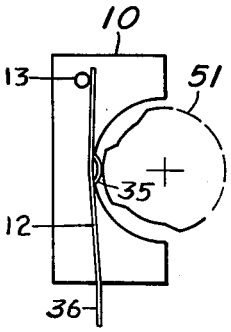
Fig. 3D
Fig. 2
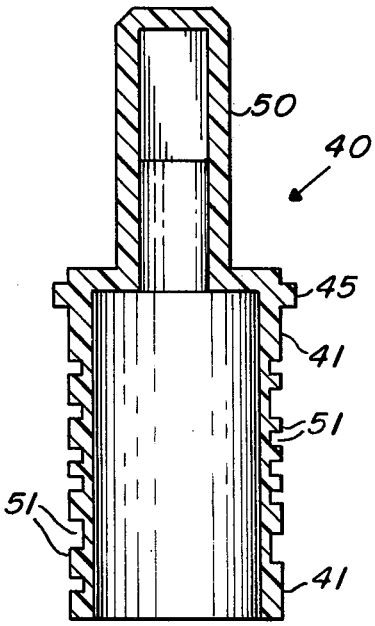
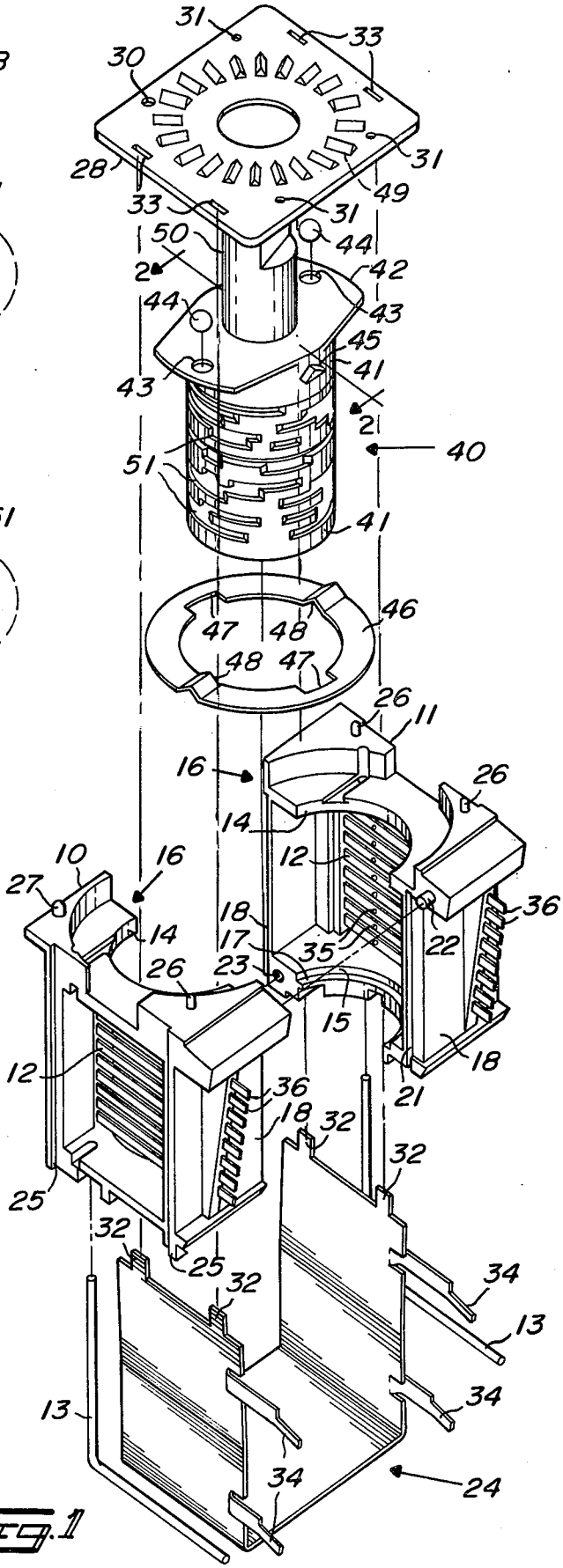
Fig. 1

BINARY CODED CAM SELECTOR SWITCH HAVING SPLIT HOUSING AND DENT STRUCTURE

BACKGROUND OF THE INVENTION

This invention relates to the field of binary coded cam selector switches and particularly to switches having extremely long life expectancy and reliability.

Many types of rotary switches are known in the art. Many of these employ a plurality of cams and a plurality of switch contracts for providing a given program or sequence of switching functions. As stated in the prior art, the vast bulk of the breakdowns or malfunctions of such rotary switches are due to a malfunction of one or more contacts. Such malfunctions are chiefly due to foreign matter in the contact area. When such malfunctions occur, one of two approaches is usually taken by repair personnel. The first approach is to replace the entire switch. In any application, this is a time consuming repair job. The second approach involves replacement and/or repair of a bad set of contacts. While this approach generally requires less stocking of repair parts, it generally requires much more repair time and the comment has been made that many rotary switches, when taken apart sufficiently to permit replacement of individual contacts, resemble nothing so much as a three dimensional jigsaw puzzle. As stated elsewhere in the prior art, miniaturization decreases operating life and reliability. While efforts have been made to improve the performance of individual contacts and to extend their life, it has not been recognized that with the appropriate approach, the necessity for repair could be postponed beyond any normally expected lifetime of the equipment in which the switch is used.

SUMMARY OF THE INVENTION

It is therefore an object of the present invention to eliminate the repair problems of the prior art selector switches by providing a switch having extremely long life and reliability.

It is a particular object to provide such a switch by preventing contact failure due to foreign matter on the contact elements.

It is another particular object to prevent failure of any component part during a life expectancy greatly in excess of that normally to be expected.

The above objectives are accomplished according to the invention by a housing arrangement which is essentially dust tight to prevent exterior dust from entering the interior of the contact portion of the housing. Component materials and platings are chosen to make all components extremely longlived, i.e., far beyond normally expected requirements. This use of individual extremely long-lived components has the added advantage of adding to the reliability of the contact function, since a part which does not wear almost certainly does not produce dust, dust being the chief cause of contact failure, other than simple mechanical breakdown of a part. When a switch is used very frequently, as for channel switching of a radio installed in a vehicle, ease of repair is not a satisfactory goal. The only satisfactory goal for such an application is a switch which will not only not break, but can be depended upon to perform a large number of switching operations (several hundred thousand make/breaks) with complete reliability.

BRIEF DESCRIPTION OF THE DRAWING

FIG. 1 is an exploded view of a switch assembly constructed in accordance with the invention.

FIG. 2 is a cross-sectional view of the molded rotary member, taken along the line 2—2 of FIG. 1.

FIGS. 3A-3D show in cross-sectional view the contact portion of the switch assembly of FIG. 1 under various loading conditions.

DESCRIPTION OF A PREFERRED EMBODIMENT

The features of the invention will be best understood in relation to the embodiments shown in the drawing, FIG. 1 being an exploded view of the entire structure. Two main housing portions 10 and 11 are, in most respects, mirror images of each other, and are molded of a plastic material having excellent wear characteristics; high abrasion resistance, low coefficient of friction, and dimensional stability. A preferred material is an acetal homopolymer known commercially as Delrin 500 or the equivalent. This material is compatible with the metal contacts 12 and shorting bar 13 which are molded therein. The molded parts are annealed at 200° F to prevent long term shrinkage. Testing for wear will be discussed hereinafter. The housing portions 10, 11 include front and rear bearing surfaces 14, 15 and a compartment or aperture 16 for the detent mechanism. Adjacent the rear bearing surface 15 is a shoulder surface 17 having a smaller diameter than the surface 15 to prevent dust from entering the contact area at this point. On the mating edges of the thinner walls 18 of the housing portion, a dust baffle is created by means of a lip on the housing portion 10 (not shown) and a cooperating shoulder 21 on the housing portion 11. For accurate alignment of the portions 10, 11, two pair of mating bosses 22 and holes 23 (not visible on portion 10) are provided. A metal housing cover or clamp 24 slides over the mated housing portions 10, 11 within the shoulder portions 25 (not visible on portion 11) thus, sealing the rear and sides of the housing. On the exterior front of the portions 10, 11 are three small bosses 26 and one large boss 27 for positioning a detent plate 28 via the apertures 30, 31 on the plate. The two sizes of bosses prevent the plate 28 from being installed incorrectly.

The housing clamp 24 is terne plated steel for corrosion resistance and has four twist tabs 32 on its front edges. The tabs 32 are inserted through four apertures 33 in the detent plate 28, then twisted to secure the plate against the housing portions 10, 11. The apertures 33 are so spaced as to inwardly bias the sides of the housing clamp 24 against the housing portions. On the lower edge of the clamp 24 are four mounting tabs 34 for attaching the entire selector switch assembly to a chassis, printed circuit board or the like.

As mentioned hereinabove, the shorting bars 13 and the contacts 12 are molded into the housing portions 10, 11, providing positive positioning thereof. The bars 13 are formed of quarter-hard brass rod, gold plated over nickel plating. The contacts 12 are stamped and formed of one quarter mill hardened beryllium copper. Contactors 35 of the contacts 12 are gold plated over nickel plating also. A thinner plating is used at the terminal ends 36 of the contacts 12 for good solderability. Since the four mounting tabs 34 on the housing clamp 24 provide firm support for the assembly, the terminals 36 are not mechanically stressed. The functioning of the contacts 12 will be discussed in detail with respect to FIG. 3.

A rotary member, designated generally as 40, is molded of the same material as the housing portions 10, 11 to achieve the same characteristics. The member 40 has bearing surfaces 41 which are supported by the bearing surfaces 14, 15 of the housing portions 10, 11. An integral flange 42 has two apertures 43 for retaining two detent balls 44, and two bosses 45 (one shown) for retaining a detent spring 46. When an uneven number of detent positions is required, one of the apertures 43 is located on a radius which is $360°/2n$ removed from the diameter on which the other aperture 43 is located, where "$n$" is the number of detent positions. The spring 46 is preferably formed of 1095 blued clock spring steel and includes two notches 47, dimensioned to slip over the bosses 45, and two locking portions 48 which cooperate with the bosses 45 to provide bias for retaining the detent balls 44 between the spring 46 and the detent plate 28. The balls 44 are made of a steel alloy, and lubricated to reduce wear (only 0.012 cc. of grease being required). The detent plate is case-hardened steel and the portions 49 of the detent plate 28 between the detent positions are shaped to prevent the detent balls from stopping in mid position. The entire detent structure provides precise positioning under vibrational or shock conditions.

Also integrally formed with the rotary member 40 is an extended portion or shaft 50 which may be formed in any suitable fashion to enable manual rotation of the member 40. Central to the member 40 are a plurality of cam sections 51 as shown in FIG. 2. The cam sections may be 0.05 inches (0.127 centimeters) on centers, the contacts 12 for the even-numbered cams being on one side of the cams 51 and those for the oddnumbered cams on the other. The staggered contacts can then be spaced on 0.1 inch (0.25 centimeter) centers, the contactors 35 being much narrower than the body of the contacts 12 to avoid touching the adjacent cam sections 51. Thus, a number of circuits equal to the number of contacts can be open or closed, according to the binary coded cams, in a number of possible combinations equal to the number of detent positions.

The four diagrams of FIG. 3 show the interaction of one of the cams 51, one of the contacts 12 and one of the shorting bars 13. FIG. 3A shows a cross-section of the housing portion 10 as molded; i.e., with shorting bar and contact in place and the contact unloaded. The axis of the unloaded contact 12 is normal to the radius of the cam 51 at the contact point, and the dimension (A) from the contact 12 to the contact bar 13 is approximately 0.05 inches (0.127 centimeters). When the switch is assembled (FIG. 3B), with the contactor 35 resting on a "low" of the binary coded cam, the contact 12 is preloaded slightly; i.e., the dimension "B" is less than "A" or approximately 0.035 inches (0.089 centimeters). As the contactor 35 rises toward a "high" on the cam, the end of the contact 12 passes through the dimension "B", coming into contact with the shorting bar 13 as shown in FIG. 3C. Upon reaching the "high" of the cam 51 (FIG. 3D), the contactor 35 has travelled a total rise of 0.031 inches (0.079 centimeters), the contact is flexed and is exerting a force of 40 grams on the shorting bar, this force being particularly important under conditions of severe shock and vibration. The contact 12 is so dimensioned that this displacement of the contactor 35 flexes the contact sufficiently to "wipe" the bar for approximately 0.004 inches (0.01 centimeters). This slight wiping action is sufficient to clean the contacting points of any small amount of foreign material which might be present in spite of the tight enclosure and non-dusting components.

Tests of switches constructed according to the invention include a life test running more than 100,000 cycles (a cycle being defined as rotation through 360°, then back through 360°). Test conditions included high humidity, abrasive dust and corrosive atmospheres, and large and abrupt changes of temperature and humidity. In addition, individual components were subjected to appropriate tests such as 1,000,000 flexures of a single contact under extreme loading conditions, and 3,000,000 flexures of the detent spring. All surfaces were carefully examined after test completion and essentially no wear or corrosion was found.

Thus, by recognition of the cause of a problem it has been possible to solve that problem and there has been provided a small, complex, binary coded selector switch having extremely long life and high reliability without excessive cost.

What is claimed is:

1. A binary coded cam selector switch assembly comprising in combination:

a rotary member molded of an abrasion resistant plastic and including integrally, axially displaced multiple coaxial cam surfaces, cylindrical bearing surfaces, a first detent member, and a control shaft;

two rigid metal contact bars;

a plurality of resilient metal contacts individually movable by contact with portions of the cam surfaces from a normal position free of the contact bars into sliding contact with said bars;

a metal detent plate supported on the control shaft of the rotary member and axially displaced from the first detent member;

two spherical metal detent elements, retained between the first detent member of the rotary member and the metal detent plate for cooperating with said plate and said member to position the cam surfaces at ones of a number of predetermined positions relative to said metal contacts;

two mating housing portions, molded of an abrasion resistant plastic, and including boss means having at least two different diameters, semi-cylindrical bearing surfaces, for cooperating with the cylindrical bearing surfaces of the rotary member, and each portion fixedly retaining one of the metal contact bars and a predetermined number of the metal contacts;

a metal housing clamp adapted to cooperate with the metal detent plate for retaining the housing portions in a tightly mated relationship, and including first tab means for retaining the metal detent plate and second tab means for mounting the switch assembly, and the metal detent plate having first apertures adapted to receive the boss means of the housing portions for proper orientation of the detent plate relative to the housing portions and second apertures adapted to receive the first tab means of the housing clamp only when the ends of the clamp are stressed toward each other.

2. A switch assembly according to claim 1 wherein each resilient metal contact has a portion molded into one of the housing portions and a contactor portion narrower than the remainder of the contact, positioned intermediate the ends of said contact and adapted to follow the contours of one of said cam surfaces, the first end of the contact extending exteriorly of the housing portion, and the second end positioned to forcefully and slidingly contact the shorting bar in said housing portion when the contactor portion is lifted by the corresponding cam surface and wherein the contacts in one housing portion are positioned to cooperate with alternate cam surfaces, said surfaces being those surfaces not used with the contacts in the other housing portion.

3. A switch assembly according to claim 2 wherein the metal contact is formed of beryllium copper, with the ends thereof being gold plated.

4. A switch assembly according to claim 1 wherein the rotary member and the housing portions are molded of annealed acetal homopolymer

5. A switch assembly according to claim 1, the rotary member further including boss portions intermediate the cam surfaces and the first detent member, the assembly further including an annular detent spring supported by the rotary member and releasably retained by the boss portions of the rotary member to cooperate with the first detent member for biasing the spherical elements against the detent plate.

6. A switch assembly according to claim 5 wherein the detent spring is formed of blued clock spring steel and the detent plate is of cadmium plated, chromated, case hardened, coal rolled steel formed to provide a predetermined number of detent positions.

7. A switch assembly according to claim 6 wherein the portions of the detent plate lying between the detent positions are formed with a convex radius on the side of said plate facing the first detent member, whereby the spherical elements are prevented from assuming positions intermediate the detent positions.

8. A switch assembly according to claim 1 wherein each metal contact bar is molded into one of the housing portions and is formed of quarter-hard brass rod, gold plated over nickel plating.

9. A switch assembly according to claim 1 wherein the housing portions, the metal detent plate and the housing clamp form dust baffles when the portions are mated and clamped.

10. A switch assembly according to claim 1 wherein the control shaft is adapted for manual rotation.

11. A switch assembly according to claim 1 wherein the means for mounting the detent plate are twist tabs and said twist tabs retain the detent plate against the housing portions.

12. A switch assembly according to claim 1 wherein the housing portions form a first compartment for containing the cam surfaces, a portion of the contact bar and a portion of each of the resilient contacts, and a second compartment for containing the detent spring, the spherical elements and the flange portion of the rotary member, the second compartment being closed by the detent plate.

* * * * *